United States Patent [19]

Ikoma

[11] 4,261,305

[45] Apr. 14, 1981

[54] TWO CYCLE INTERNAL COMBUSTION ENGINE

[75] Inventor: Takahiro Ikoma, Iwata, Japan

[73] Assignee: Yamaha Hatsudoki Kabushiki Kaisha, Iwata, Japan

[21] Appl. No.: 60,853

[22] Filed: Jul. 26, 1979

[51] Int. Cl.[3] ..... F02B 75/20; F02B 33/04; F01M 1/00

[52] U.S. Cl. ..... 123/59 B; 123/73 A; 123/73 R; 123/73 AD; 123/196 CP; 123/196 R

[58] Field of Search ..... 123/59 B, 73 A, 73 AD, 123/73 R, 196 CP, DIG. 2, 196 R

[56] References Cited

U.S. PATENT DOCUMENTS

| | | | |
|---|---|---|---|
| 2,936,748 | 5/1960 | Jensen | 123/196 CP |
| 4,121,551 | 10/1978 | Turner | 123/196 CP X |

*Primary Examiner*—Wendell E. Burns
*Attorney, Agent, or Firm*—Armstrong, Nikaido, Marmelstein & Kubovcik

[57] ABSTRACT

A two cycle internal combustion engine is disclosed, which essentially comprises a cylinder consisting of a sleeve and a cylinder block housing the sleeve therein. The cylinder has a groove formed between the sleeve and the cylinder block and at least one lubricant outlet port having one end opened to the inside of the sleeve and the other end communicating with the groove. A lubricant inlet port is formed in a crankcase or an air-fuel intake passage of the carburetor connected to the crankcase, and is connected to the groove through a lubricant passage means including a check valve disposed therein.

12 Claims, 11 Drawing Figures

TWO CYCLE INTERNAL COMBUSTION ENGINE

BACKGROUND OF THE INVENTION

The present invention relates to a two cycle internal combustion engine and, more particularly, a two cycle engine having an improved lubricating system for the cylinder and piston assembly.

Known lubricating systems for two cycle internal combustion engines are broadly divided into two types, which are a mixture lubricating system which supplies the lubricant in the form of a mixture with a fuel and an independent lubricating system in which the prescribed amount of the lubricant is supplied independent of the fuel with use of an oil tank and oil pump. In comparison to the latter system, the former is more advantageous in that it can dispense with a complex lubricant feeding device, and therefore it is more widely employed in internal combustion engines of a relatively small size in particular.

On the other hand, however, the mixture lubricating system has some difficulties: For example, with that system, it is difficult to have a sufficient amount of the lubricant be supplied effectively over an area where lubrication is required. Also, since the content ratio of the lubricant in the fuel-lubricant mixture is then constant irrespective of a variation in the load condition, the lubricant has to be contained in the mixture at a more or less higher ratio than required in preparation against a piston seizing, whereby it is likely that the lubricant cannot be completely burnt and that an unburnt portion of the lubricant can be discharged out of the engine together with the exhaust gas. Whereas it can take place also in the case of the independent lubricating system, such releasing of unburnt lubricant out of the engine, if occurs, gives rise to water pollution in the case of outboard engines or atmospheric pollution in the instance of engines for land vehicles.

In view of the above, it has of late been proposed to reduce the content ratio of the lubricant in the fuel-lubricant mixture so as to accordingly reduce the amount of unburnt lubricant discharged. However, to lower the content ratio of lubricant in the mixture inevitably accompanies an insufficient lubrication possibly to occur in various portions of the engine, particularly between the cyclinder and the piston, which then tend to undergo a piston scuff. Piston scuff occurs particularly about such portion of the cylinder as located at the sides of an exhaust port and away the same port toward the bottom of the cylinder.

Conventionally, it has been proposed as means for cancelling the above indicated difficulties to let the portion of lubricant accumulated in the crankcase be recycled to the inside of the cylinder through a lubricant outlet port provided in the inner wall surface of the cylinder by utilization of the pressure variation caused within the crankcase responsive to the engine operation, and thereby effect lubrication for the piston. However, technically it involves high difficulties to process to provide by drilling a lubricant outlet port at a necessary portion of the cylinder inner wall surface. Particularly, it is extremely difficult to have the outlet port drilled in the vicinity of the exhaust port or, more specifically, at a lower portion adjacent the exhaust port where piston scuff is highly likely to take place. Thus, conventionally the processing for the formation of a lubricant outlet port can be worked only at a limited portion or portions of the cylinder, and it accordingly is difficult to effect a sufficient and uniform lubrication for the piston and cylinder assembly.

BRIEF SUMMARY OF THE INVENTION

A primary object of the present invention is, therefore, to provide a two cycle internal combustion engine with which the provision of a lubricant outlet port can be processed at any optional point of the cylinder.

Another object of the invention is to provide a two cycle internal combustion engine which can be operated with a fuel-lubricant mixture having only a relatively low content ratio of a lubricant.

A still another object of the invention is to provide a two cycle internal combustion engine in which a sufficient lubrication for the cylinder can be effected with use of a fuel-lubricant mixture containing the lubricant at a relatively low content ratio.

A yet another obejct of the invention is to provide a two cycle internal combustion engine in which a uniform lubrication for the cylinder can be effected.

A yet still another object of the invention is to provide a two cycle internal combustion engine suitable for an outboard motor.

Those objects in view, the present invention provides a two cycle internal combustion engine including a cylinder which characteristically consists of a sleeve and a cylinder block housing the sleeve therein and a piston which is reciprocated in the sleeve. The cylinder includes a groove formed to either or both of the sleeve and the cylinder block and at least one lubricant outlet port having one end opened to the inside of the sleeve and the other end communicating with the groove. The engine also includes a crankcase extending from the cylinder, which is connected to and air-fuel mixture intake passage of a carburetor, and a lubricant inlet port is formed in an inside wall of either or both of the crankcase and the air-fuel intake passage. The engine of the invention also characteristically includes a lubricant passage means such as a conduit connecting the lubricant inlet port to the groove and having a check valve disposed therein, which permits the lubricant to flow from the crankcase and prevents it from flowing into the crankcase. advantages of the present invention will become known by reference to the following description and the accompanying drawings.

DETAILED DESCRIPTION OF THE PREFERRED EMBODIMENTS

Figure 1:
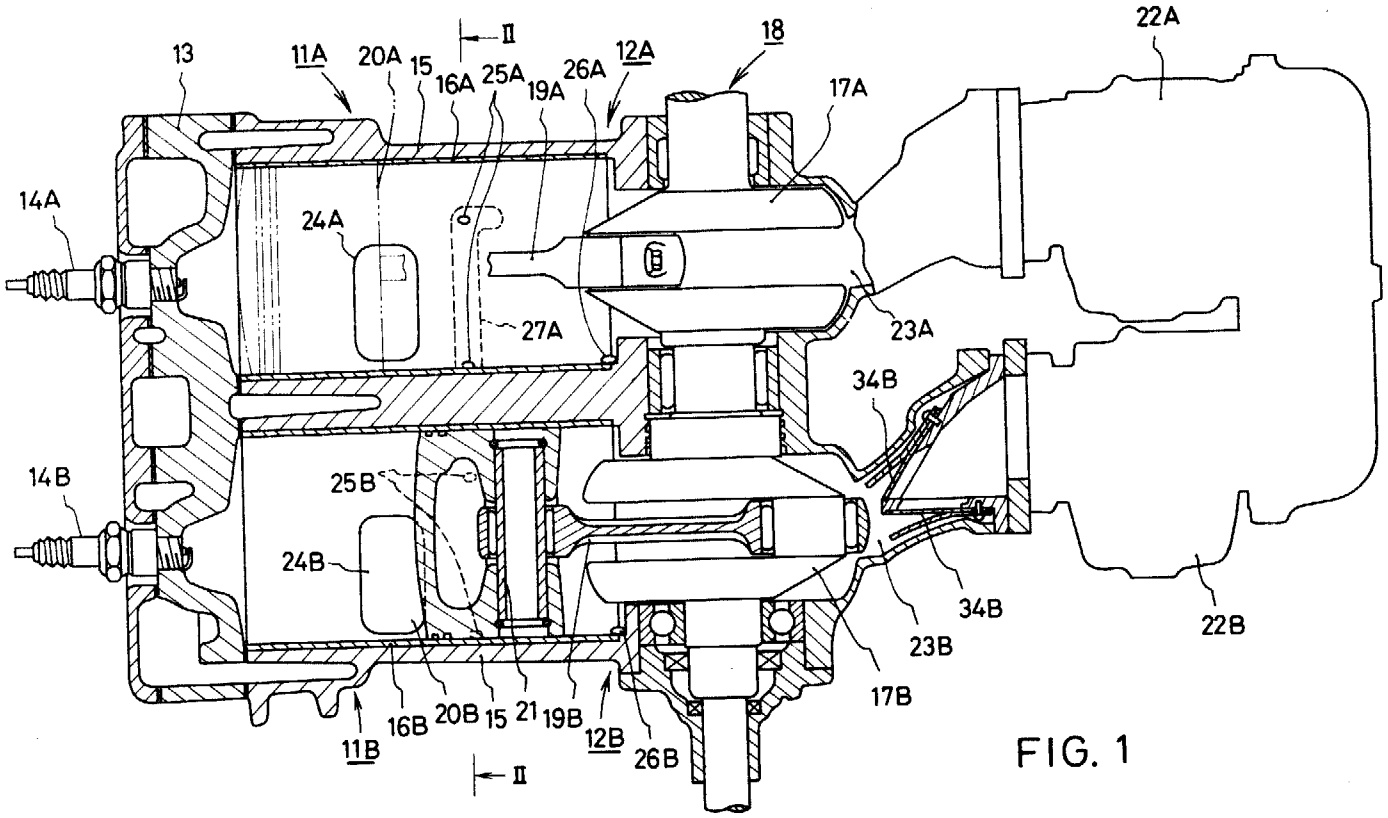
FIG. 1 is a front view, showing partially in section a two cycle internal combustion engine according to a first embodiment of the present invention.

Referring now to the accompanying drawings and FIG. 1 thereof initially, which shows a front view in section of a horizontal two cylinder, two cycle engine suitable for outboard motors, the illustrated engine broadly is composed of two cylinders 11A and 11B, two respectively associated crankcases 12A and 12B, and a cylinder head 13 capped over the two cylinders 11A and 11B. The cylinder head 13 supports spark plugs 14A and 14B respectively for cylinders 11A and 11B, which are structured by sleeves 16A and 16B press fitted in a cylinder block 15, and the crankcases 12A and 12B are disposed in extended bottom portions of the cylinders 11A and 11B, respectively. Through crankcases 12A and 12B, a crank shaft 18 having crank arms 17A and 17B is rotatably journaled, and to crank pins of the crank arms 17A and 17B, connecting rods 19A and 19B are rotatably connected, respectively. Connecting rods 19A and 19B have pistons 20A and 20B connected to their respective other ends through piston pins 21, and pistons 20A and 20B are driven to reciprocate in sleeves 16A and 16B, respectively. The reciprocation of pistons 20A and 20B is made at a phase difference of 180° with respect to their respective crank angles: In operation, the pistons 20A and 20B are alternately driven in a manner such that when the former is at its top dead center the latter is at its bottom dead center, and when the former is at its bottom dead center, the latter at its top dead center, to thereby let the crank shaft 18 rotate through connecting rods 19A and 19B and crank arms 17A and 17B. Reference characters 22A and 22B represent carburetors, of which air-fuel mixture intake passages 23A and 23B are respectively connected to crankcases 12A and 12B so as to supply an air-fuel mixture containing a lubricant into the crankcases. The air-fuel intake passage 23B is provided with a reed valve 34, which can open to permit the air-fuel mixture to enter the crankcase 12B when the piston 20B is moved toward the cylinder head to generate a negative pressure within the crankcase 12B and, on the contrary, become closed to check the back flow of the fuel mixture into the crankcase when the piston 20B is moved toward the cylinder bottom, producing a positive pressure within the crankcase 12B. A same reed valve as above is provided to the other air-fuel intake valve 23A, too.

To sleeves 16A and 16B, scavenging ports (not shown) and exhaust ports 24A and 24B are opened, and two lubricant outlet ports 25A and 25B are also opened respectively in sleeves 16A and 16B in their portions located at the sides of the exhaust ports and apart therefrom toward the cylinder bottom. At lower bottom portions of crankcases 12A and 12B, there are provided inlet ports 26A and 26B for the lubricant.

Figure 2:
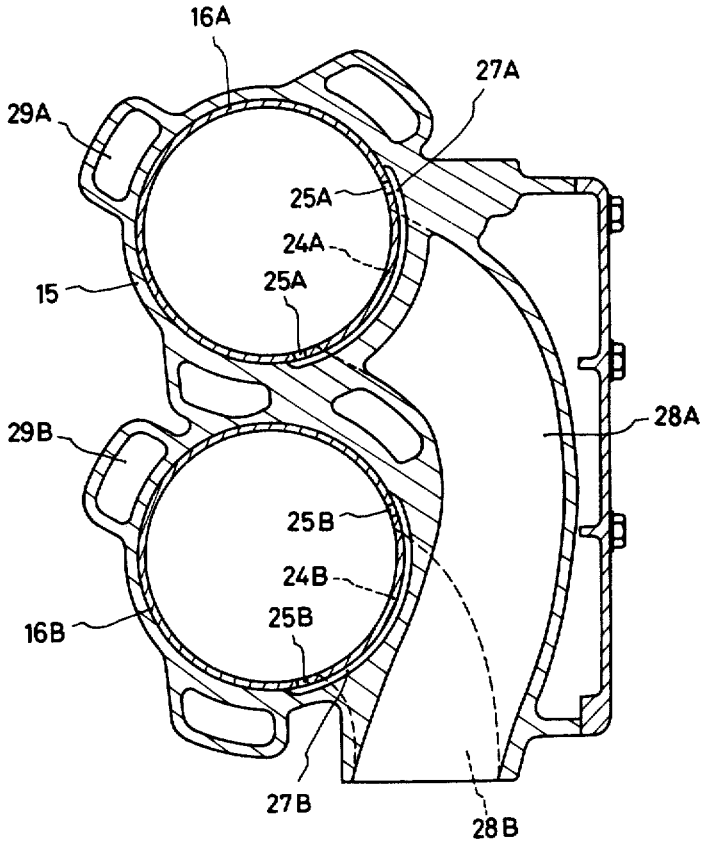
FIG. 2 is a sectional view taken on line II—II of FIG. 1.

As shown in FIG. 2, then, the cylinder block 15 housing sleeves 16A and 16B press fitted therein has grooves 27A and 27B formed at the portions thereof corresponding to the location of outlet ports 25A and 25B. The groove 27A communicates with each other the two outlet ports 25A, and similar to that, the groove 27B communicates the two ports 25B with each other. Exhaust ports 24A and 24B are respectively connected to exhaust passages 28A and 28B. Reference characters 29A and 29B denote scavenging passages respectively connected to scavenging ports (not shown).

Figure 3:
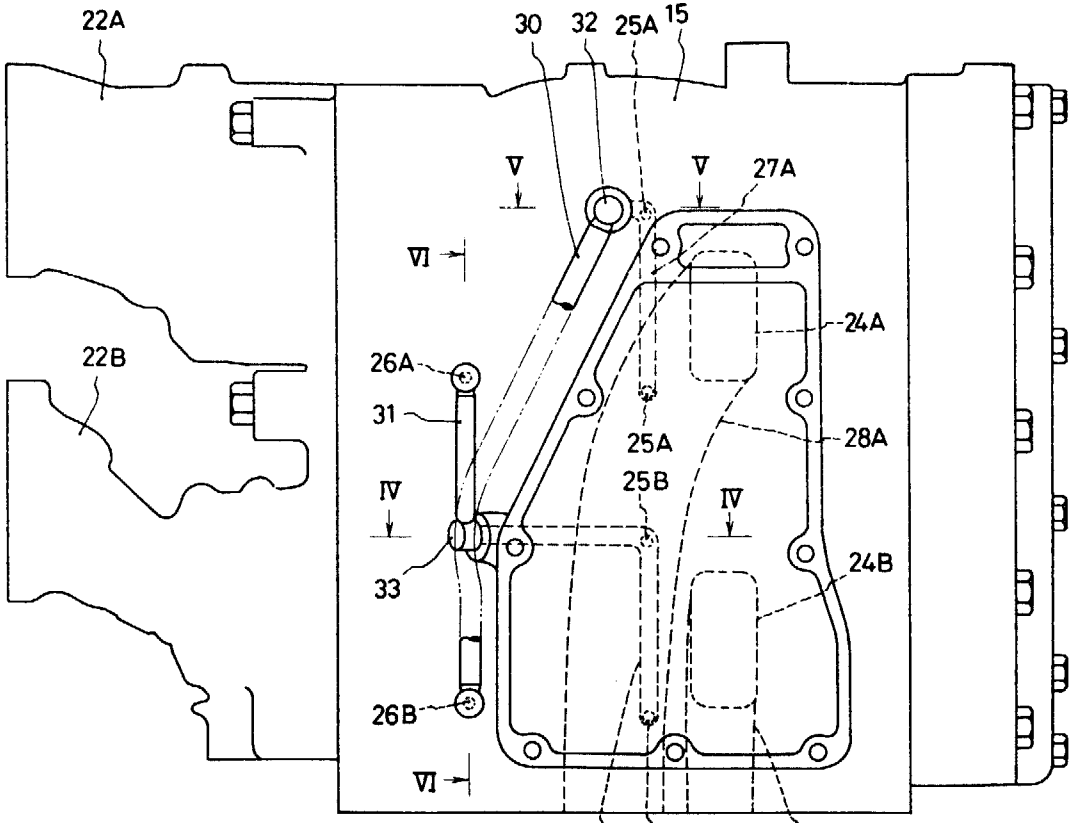
FIG. 3 is a rear view of the engine of FIG. 1.

In FIG. 3, which shows a rear side view of the engine of FIG. 1, the groove 27A communicating the lubricant outlet ports 25A with each other and also the groove 27B communicating the outlet ports 25B with each other are, both, bent in an L-shaped pattern and connected at their respective one ends to outer lubricant passage means or conduits 30 and 31 provided rear side of the cylinder block 15, through check valves 32 and 33, respectively.

Figure 4:
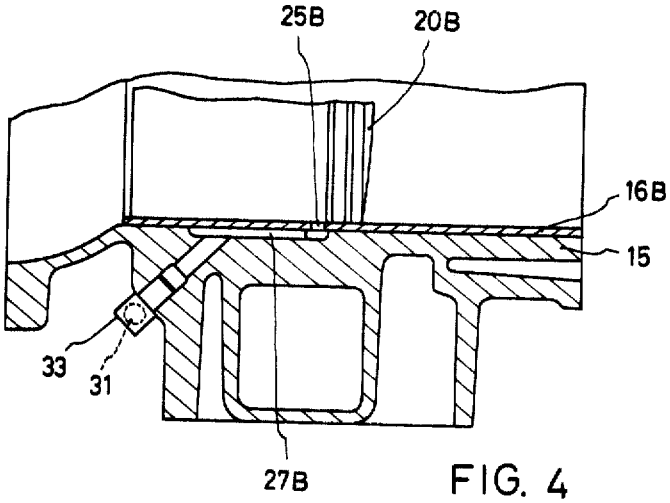
FIG. 4 is a sectional view taken on line IV—IV of FIG. 3.
Figure 5:
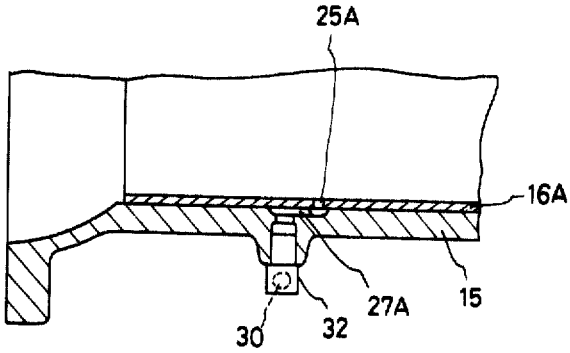
FIG. 5 also is a sectional view, taken on line V—V of FIG. 3.

FIGS. 4 and 5 are sectional view, showing the manner in which the ends of L-shaped grooves 17A and 27B are in communication with outer conduits 30 and 31 through valves 32 and 33, respectively.

Figure 6:
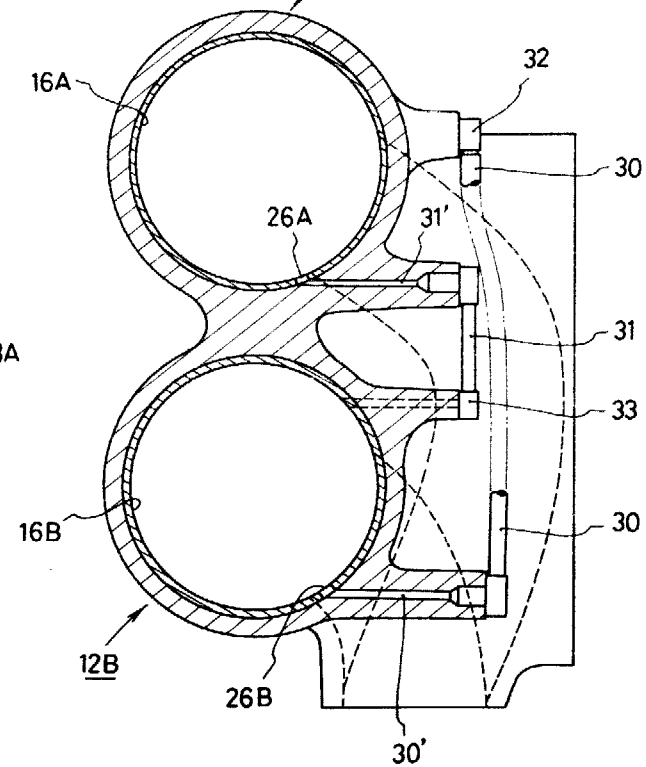
FIG. 6 also is a sectional view, taken on line VI—VI of FIG. 3.

As shown in FIG. 6, the conduit 30 in communication with the groove 27A is connected through a conduit 30' to the lubricant inlet port 26B provided through the crankcase 12B. Similarly, the conduit 31 in communication with the groove 27B is connected through a conduit 31' to the inlet port 26A of the crankcase 12A. Under a positive pressure condition within the crankcases 12A and 12B, check valves 32 and 33 will open the passage through the conduits and permit the lubricant to flow from the crankcases, but under a negative pressure condition within the crankcases, they close the passage and check a back flow of the lubricant into the crankcase.

When the above described engine is actuated, lubrication for the piston and cylinder may be effected in the following manner.

Assuming that the pistons 20A and 20B are, respectively, at their bottom and top dead centers as shown in FIG. 1, within crankcases 12B and 12A there are positive and negative pressure conditions created, respectively, and such a portion of the lubricant contained in the air-fuel mixture as was preparatively accumulated at a lower bottom portion of the crankcase 12B by flowing down along the wall surface thereof will then be forced to enter the passage means or conduit 30 by the positive pressure within the crankcase 26B. The lubricant portion guided into conduit 30, which flows to open the check valve 32, is led into groove 27A of cylinder 11A and, through the two outlet ports 25A, further into the sleeve 16A, about the inner wall surface thereof. Piston 20A is, then, at the top side of the cylinder, so that a negative pressure condition is created within the cylinder 11A about a portion thereof at which the ports 25A are provided, whereby the above flow of lubricant can be further smoothly promoted. The lubricant outlet ports 25A are provided at such portions on the inner wall surface of the cylinder 11A at which a lack or shortage of lubricant is most likely to occur, that is, portions located, longitudinally, away the exhaust port 24A toward the bottom side of the cylinder and, transversely, at sides of the exhaust port 24A, so that lubrication can be performed in an optimum manner. Further, the groove 27A formed between the abutting surfaces of cylinder block 15 and sleeve 16A and on the rear sides of outlet ports 25A communicating the same with each other can also function to temporarily reserve the lubricant therein, and it is accordingly more useful for enhancing the lubrication efficiency relative to the cylinder. In cases where the outlet ports 25A are provided in a number of 2 or more, it is likely that the flow-out amount of lubricant can be greater through a lower located outlet port on account of the gravity. Accordingly, the location at which the conduit 30 is connected to groove 27A communicating the plurality of ports 25A with one another should preferably be at the side at which a highest located outlet port is present, in consideration of the gravity application. By employing the above arrangement for lubrication, it is feasible to supply a lubricant uniformly within the cylinder. It will be readily understood that lubrication relative to the other cylinder 11B can be carried out when the pistons 20A and 20B move toward the bottom dead center and the top dead center of the cylinder, respectively, and in a same manner as described above in connection with the lubrication for the cylinder 11A.

As is widely accepted in the art, it accompanies high difficulties to perforate a lubricant outlet port, by drilling, always at an optional portion of the inner wall of an engine cylinder. Particularly, it is difficult to operate drilling of a port through a portion of the cylinder inner wall located away the exhaust port toward the cylinder bottom side.

According to the present invention described above, the engine cylinder is so structured as to comprise an inner sleeve press fitted into a cylinder block, and with a groove formed between the cylinder block and the sleeve, the groove is communicated with the interior of the sleeve through an outlet port, whereby the above difficulties in processing are effectively eliminated. That is to say, with the above described embodiment of the present invention, before it is operated to assemble sleeves 16A and 16B in cylinder block 15 by press fitting, it may be operated to provide outlet ports 25A and 25B respectively to sleeves 16A and 16B and also form grooves 27A and 27B to the cylinder block 15, and subsequent to such preparative processing of the sleeves and cylinder block, the former may be press fitted into the latter. By following the above manner of processing and assembling, it is operable with ease to provide the outlet ports at always at any optional part of the cylinder.

Figure 7:
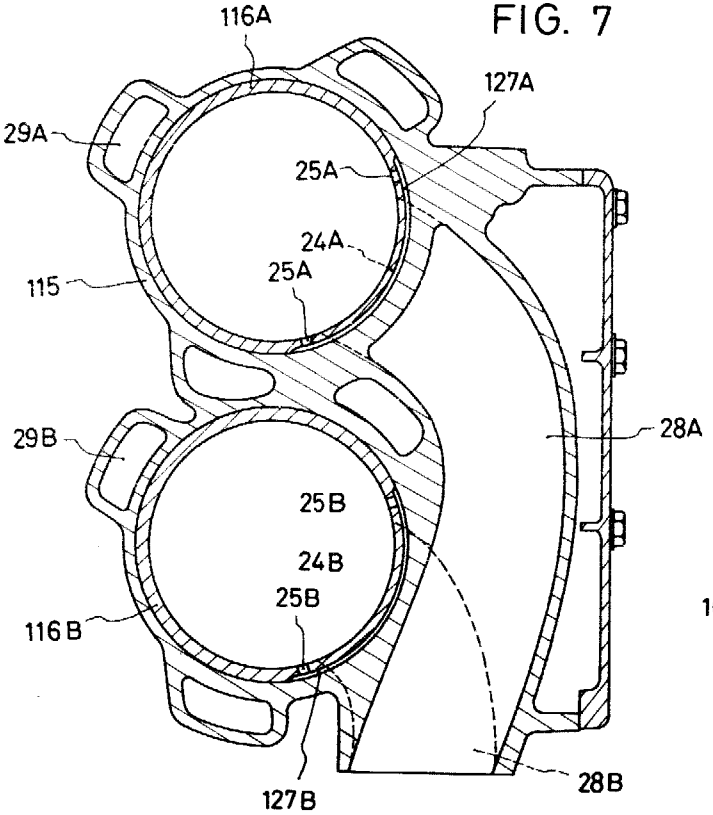
FIG. 7 is a sectional view of a two cycle internal combustion engine according to a second embodiment of the present invention, showing the portion thereof corresponding to that shown in FIG. 2.

FIG. 7 shows a sectional view of an engine according to a second embodiment of the present invention and, more specifically, the portion thereof corresponding to the portion shown in FIG. 2 of the engine of the embodiment described above.

Whereas in the embodiment considered above grooves 27A and 27B are formed to the cylinder block 15, in the embodiment now to be considered in conjunction with FIG. 7 the corresponding grooves 127A and 127B are provided about the outer peripheral surface of sleeves 116A and 116B to be press fitted in the cylinder block 15, the sleeves being so made as to have a more or less increased wall thickness.

Figure 8:
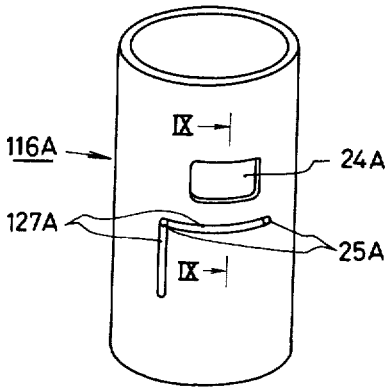
FIG. 8 shows a perspective view of a sleeve used in the engine shown in FIG. 7.
Figure 9:
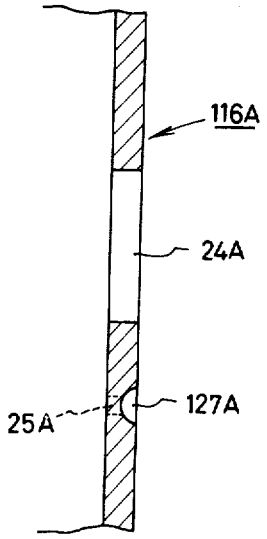
FIG. 9 is a sectional view taken on line IX—IX of FIG. 8.

FIGS. 8 and 9 illustrate the sleeve 116A before it is assembled within the block 115, and as illustrated, the sleeve has on its outer surface the groove 127A formed in an L-shape extending in both circumferential and axial directions of the sleeve. Outlet ports 25A are perforated through the sleeve wall to open in the groove 127A. It will be readily understood that in the instance of this embodiment, too, a same ease as in the embodiment first above considered is realized, for the processing to provide the lubricant outlet port. Also, the grooves can be formed relative to not only either of the cylinder block and the sleeve, but also both of them. Further, the integral assemblage of the cylinder block and sleeves, which is made in the above description by press fitting the latter into the former, may be made also by casting, and in that case, steps may be taken as follows:

That is to say, it may be operated to preparatively form lubricant inlet ports to the sleeve, attach a mold core made of salt convex in section to the portion on the circumferential surface of the so processed sleeve corresponding to the location of the inlet port, and place the sleeve having the salt core attached thereto as above within a mold, followed by pouring into the mold a molten metal such as molten aluminum. Subsequently, when the poured molten metal has been solidified, the mold may be removed away and the cast product may be immersed in water bath maintained at about 80° C., whereby the salt core can become dissolved in water and a cylinder block having a groove of the concavity corresponding to the convex sectional configuration of the salt core can be provided.

Figure 10:
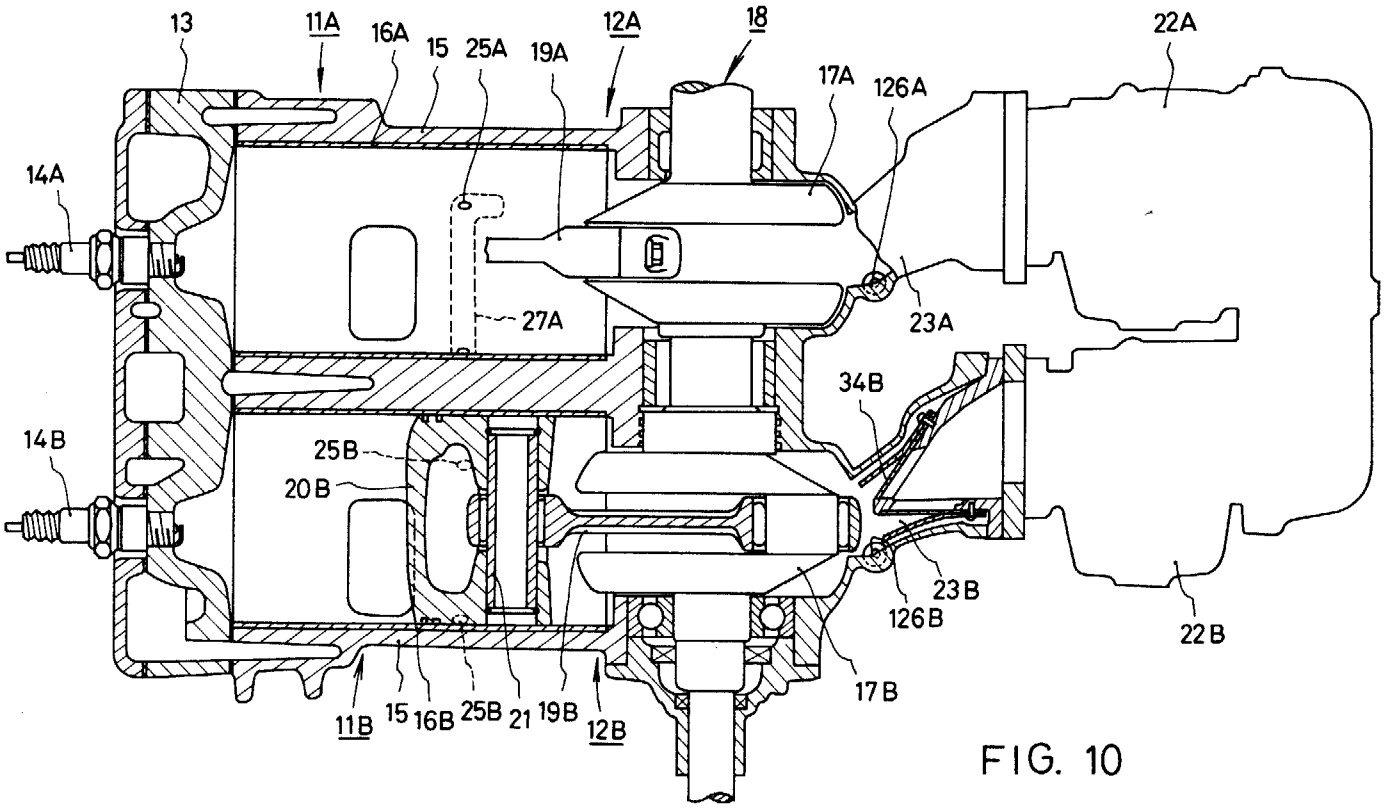
FIG. 10 is a front view, showing partially in section a two cycle internal combustion engine according to a third embodiment of the present invention.
Figure 11:
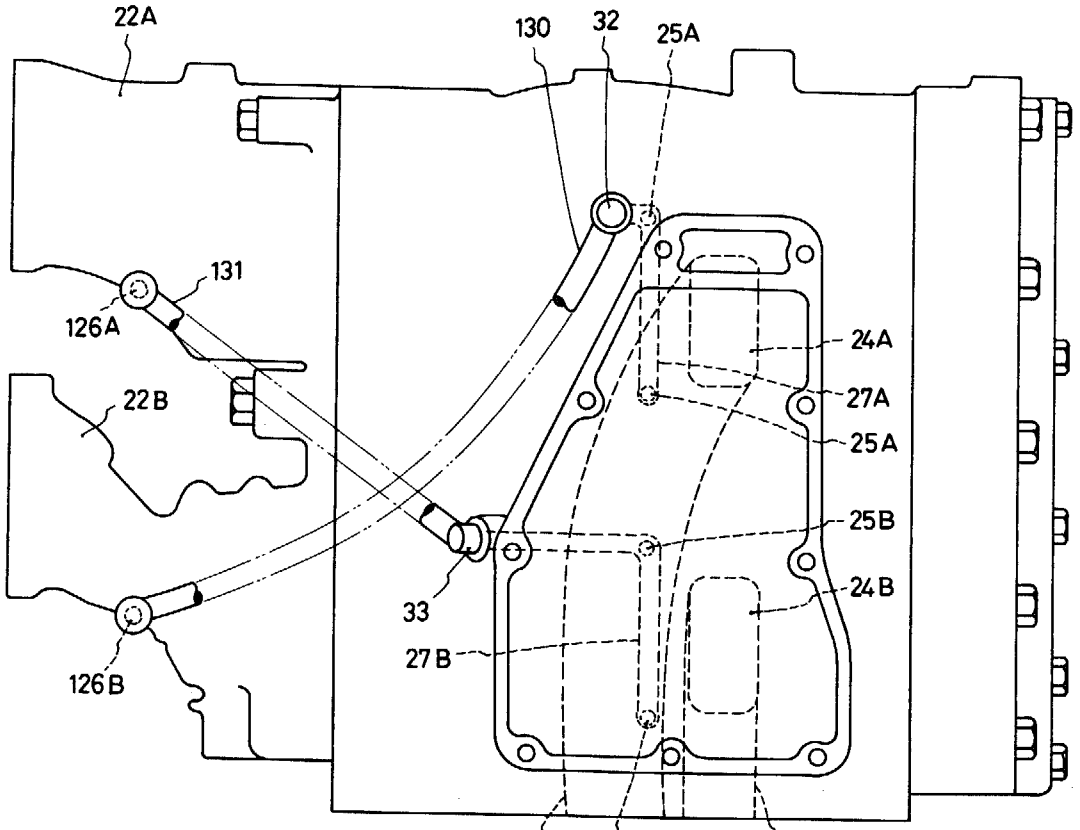
FIG. 11 shows a rear view of the engine of FIG. 10.

FIGS. 10 and 11 illustrate a still another embodiment of the present invention, in which all component members and parts of the engine are identical with those of the embodiment shown in FIG. 1, except that the lubricant inlet ports, which are provided in the embodiment of FIG. 1 to crankcases 12A and 12B, as indicated at 26A and 26B in FIG. 1, are provided in the air-fuel intake passages 23A and 23B of carburetors 22A and 22B, as indicated at 126A and 126B in FIGS. 10 and 11. The lubricant mixed in the air-fuel mixture, which will flow on the inner surface of the cylinder, tends to accumulate at a lower end portion of the air-fuel intake passages 23A and 23B, and it is intended with the embodiment under consideration to positively utilize such accumulated portion of the lubricant for lubrication of the cylinder. As shown in FIG. 11, the inlet port 126A is connected to lubricant passage means or conduit 131 and, through a check valve 33, further to the groove 27B and outlet ports 25B. Similarly, the inlet port 126B is connected to conduit 130 and, through check valve 32, to groove 27A and outlet ports 25A. The same as in the embodiments first and second above considered, in the engine of the embodiment now under consideration, too, lubrication of the cylinder and the piston can take place in a highly desirable manner.

Although the foregoing description of the preferred embodiments of the invention is limitedly in connection with a horizontal cylinder engine for outboard motors only, it will be understood that the concept of the present invention can be effectively applied to the cases of vertical or inclined type two cycle internal combustion engines for use for motorcycles and so forth. It will also be understood that the present invention is applicable to single cylinder type engines, same effectively as in the case of two cylinder engines of the above described embodiments. Similarly, the invention should be understood as being applicable irrespective of a difference in the lubrication system, whether a mixture lubrication or a separate independent lubrication. Further, it is to be understood that according to the present invention, the passage means for the lubricant is not limited to a pipe or a similar conduit provided external to the cylinder block but can comprise a groove, slot or hole alone drilled or otherwise provided in the cylinder block.

As described above, according to the present invention, the cylinder of an engine is composed of an inner sleeve and a cylinder block externally surrounding the sleeve, and lubricant outlet ports are provided to the sleeve to be in lubricant communication with each other through a groove formed between the cylinder block and the sleeve. Therefore, before the sleeve is incorporated into the cylinder block, it is operable to provide the lubricant outlet port at an optional location through the sleeve wall, whereby the processing for the formation of lubricant outlet ports can be greatly simplified. Such simplification of the processing makes operable to provide a lubricant outlet port freely at any optional point of the cylinder, permits lubrication for cylinder and piston to take place at an enhanced degree of efficiency, and also makes feasible to operate the engine with an air-fuel mixture containing a lubricant at only a relatively reduced ratio.

What is claimed is:

1. A two cycle internal combustion engine which comprises a horizontal cylinder having an axis and consisting of a sleeve and a cylinder block surrounding said sleeve, said cylinder including a groove formed between said sleeve and said cylinder block perpendicular to said axis having a high end and a low end, and a plurality of outlet ports, one end of each of the outlet ports being opened to the inside of said sleeve and the other end communicating with said groove, a piston being reciprocated in said sleeve, a crankcase extending from said cylinder and having an inlet port on the inside thereof, a lubricant passage means connecting said inlet port to said groove at said high end, and a check valve in said lubricant passage means preventing flow to said crankcase and permitting flow from said crankcase.

2. A two cycle internal combustion engine in accordance with claim 1, wherein a pair of parallel disposed cylinders and separate crankcases extending from each of said cylinders are provided and the inlet ports of the crankcases are connected respectively to the grooves of the cylinders of the other side through the lubricant passage means whereby positive pressure in one crankcase and correlative negative pressure in the other crankcase induces flow of lubricant through said lubricant passage means.

3. A two cycle internal combustion engine in accordance with any of the claims 1 and 2, wherein said outlet ports are located on said sleeve at a point adjacently spaced from both sides of an exhaust port toward the bottom end of said sleeve.

4. A two cycle internal combustion engine in accordance with any of claims 1 and 2, wherein said groove is disposed on the inside surface of said cylinder block.

5. A two cycle internal combustion engine in accordance with any of claims 1 and 2, wherein said groove is disposed on the outside surface of said sleeve.

6. A two cycle internal combustion engine in accordance with any of claims 1 and 2, wherein said engine is used for an outboard motor.

7. A two cycle internal combustion engine which comprises a horizontal cylinder having an axis and consisting of a sleeve and a cylinder block surrounding said sleeve, said cylinder including a groove formed between said sleeve and said cylinder block perpendicular to said axis having a high end and a low end, and a plurality of outlet ports, one end of each of the outlet ports being opened to the inside of said sleeve and the other end communicating with said groove, a piston being reciprocated in said sleeve, a crankcase extending from said cylinder and being connected to an air-fuel intake passage of a carburetor, said air-fuel intake passage having an inlet port, a lubricant passage means connecting said inlet port to said groove at said high end, and a check valve in said lubricant passage means preventing flow to said crankcase and permitting flow from said crankcase.

8. A two cycle internal combustion engine in accordance with claim 7, wherein a pair of parallel disposed cylinders and separate crankcases extending from each of said cylinders are provided and the inlet ports of the crankcases are connected respectively to the grooves of the cylinders of the other side through the lubricant passage means whereby positive pressure in one crankcase and correlative negative pressure in the other crankcase induces flow of lubricant through said lubricant passage means.

9. A two cycle internal combustion engine in accordance with any of claims 7 and 8, wherein said outlet ports are located on said sleeve at a point adjacently spaced from both sides of an exhaust port toward the bottom end of said sleeve.

10. A two cycle internal combustion engine in accordance with any of claims 7 and 8, wherein said groove is disposed on the inside surface of said cylinder block.

11. A two cycle internal combustion engine in accordance with any of claims 7 and 8, wherein said groove is disposed on the outside surface of said sleeve.

12. A two cycle internal combustion engine in accordance with any of claims 7 and 8, wherein said engine is used for an outboard motor.

* * * * *